US011858668B2

(12) United States Patent
Tillack et al.

(10) Patent No.: US 11,858,668 B2
(45) Date of Patent: Jan. 2, 2024

(54) METHOD FOR FILLING AN AT LEAST PARTIALLY GAS-PERMEABLE CONTAINER

(71) Applicant: Greif-Velox Maschinenfabrik GmbH, Lübeck (DE)

(72) Inventors: Bernd Tillack, Lübeck (DE); Jan Lorenzen, Lübeck (DE); Janis Feye, Lübeck (DE); Alexander Mildner, Lübeck (DE); Alexander Boje, Lübeck (DE)

(73) Assignee: Greif-Velox Maschinenfabrik GmbH, Lübeck (DE)

( * ) Notice: Subject to any disclaimer, the term of this patent is extended or adjusted under 35 U.S.C. 154(b) by 0 days.

(21) Appl. No.: 17/575,845

(22) Filed: Jan. 14, 2022

(65) Prior Publication Data

US 2022/0332446 A1 Oct. 20, 2022

(30) Foreign Application Priority Data

Apr. 14, 2021 (EP) ..... 21168396

(51) Int. Cl.

| | |
|---|---|
| ***B65B 1/16*** | (2006.01) |
| ***B65B 1/18*** | (2006.01) |
| ***B65B 1/26*** | (2006.01) |
| ***B65B 1/32*** | (2006.01) |

(52) U.S. Cl.

CPC ..... *B65B 1/16* (2013.01); *B65B 1/18* (2013.01); *B65B 1/26* (2013.01); *B65B 1/32* (2013.01)

(58) Field of Classification Search

CPC .... B65B 1/04; B65B 1/16; B65B 1/18; B65B 1/26; B65B 1/32

See application file for complete search history.

(56) References Cited

U.S. PATENT DOCUMENTS

| | | | | | |
|---|---|---|---|---|---|
| 2,783,786 | A | * | 3/1957 | Carter | B67C 3/30 141/286 |
| 3,716,082 | A | * | 2/1973 | Green | B65B 1/18 406/146 |
| 4,872,493 | A | * | 10/1989 | Everman | B65B 39/04 141/73 |
| 5,109,893 | A | * | 5/1992 | Derby | B65B 1/26 141/10 |
| 5,244,019 | A | * | 9/1993 | Derby | B65B 1/26 222/452 |
| 5,279,339 | A | * | 1/1994 | Derby | B65B 1/26 141/73 |

(Continued)

FOREIGN PATENT DOCUMENTS

| | | | |
|---|---|---|---|
| DE | 102008054717 | A1 | 6/2010 |
| DE | 102016108324 | A1 | 11/2017 |

(Continued)

*Primary Examiner* — Nicolas A Arnett

(74) *Attorney, Agent, or Firm* — McGlew and Tuttle, P.C.

(57) ABSTRACT

A method for filling a receptacle (7), which is at least partly gas-permeable with bulk filling material (2), includes subjecting the receptacle (7) at the outer side to an underpressure, in order to generate a feed of filling material through a filling material conduit (4) into the inside of the receptacle (7). The filling procedure is assisted by way of subjecting the filling material conduit (4) to pressure after completion of a first filling time.

20 Claims, 3 Drawing Sheets

(56) References Cited

U.S. PATENT DOCUMENTS

| | | | | | |
|---|---|---|---|---|---|
| 5,531,252 | A * | 7/1996 | Derby | B65B 1/26 | 141/71 |
| 5,573,044 | A * | 11/1996 | Mechalas | B65B 1/32 | 141/10 |
| 5,682,929 | A * | 11/1997 | Maginot | B65B 43/56 | 141/10 |
| 6,860,301 | B2 * | 3/2005 | Schaffer | B65B 1/28 | 141/73 |
| 7,168,460 | B2 * | 1/2007 | Dietrich | B65B 1/16 | 414/217 |
| 7,231,947 | B2 * | 6/2007 | Boroch | B65B 1/16 | 141/315 |
| 7,267,144 | B2 * | 9/2007 | Nyhof | B65B 1/04 | 141/114 |
| 11,021,310 | B2 * | 6/2021 | Nelson | B65D 81/2023 | |
| 11,390,402 | B2 * | 7/2022 | Towne | B65B 1/26 | |
| 2006/0283149 | A1 * | 12/2006 | Passini | B65B 31/045 | 53/469 |
| 2009/0229703 | A1 * | 9/2009 | Purnhagen | B65D 88/1681 | 141/10 |
| 2010/0012220 | A1 * | 1/2010 | Waldron | B65B 39/08 | 141/10 |
| 2012/0180435 | A1 * | 7/2012 | Stelluti | B65B 1/24 | 53/469 |
| 2012/0204522 | A1 * | 8/2012 | Kondo | B65B 1/32 | 53/551 |

FOREIGN PATENT DOCUMENTS

| | | | | | |
|---|---|---|---|---|---|
| EP | 2288544 | B1 | 7/2012 | | |
| EP | 3581500 | P | 12/2019 | | |
| WO | WO-9912813 | A1 * | 3/1999 | B65B 1/16 | |

* cited by examiner

METHOD FOR FILLING AN AT LEAST PARTIALLY GAS-PERMEABLE CONTAINER

CROSS REFERENCE TO RELATED APPLICATIONS

This application claims the benefit of priority under 35 U.S.C. § 119 of European Application 21168396.6, filed Apr. 14, 2021, the entire contents of which are incorporated herein by reference.

TECHNICAL FIELD

The invention relates to a method for filling a receptacle which is at least partly gas-permeable, as well as to a filling device for carrying out this method.

TECHNICAL BACKGROUND

For filling gas-permeable receptacles with bulk filling material, it is counted as belonging to the state of the art to transport the filling material into the receptacle by way of a pressurized air flow, wherein the pressurized air passes through the gas-permeable wall of the receptacle and the filling material remains in the receptacle. By way of such a pressure increase, in particular filling material with a medium bulk density can be filled in an accelerated manner, as can be the case for example on filling flexible intermediate bulk containers (FIBCs).

In particular, for filling material of a low density and a fine granulation, it is counted as belonging to the state of the art to transport the filling material by way of vacuum suction. On filling by way of such vacuum packers, as is counted as belonging to the state of the art from DE 10 2008 054 717 A1, the receptacle which is to be filled, for example a paper valve sack is sealingly applied onto a filling spout within an evacuable chamber, wherein after opening the filling material conduit and evacuating the chamber, the filling material is transported through the filling spout into the gas-permeable valve sack and the entrained air goes through the wall of the sack into the valve chamber and is sucked away there. This chamber is subjected to an underpressure by way of a vacuum pump during the filling procedure. For the exchange of a filled receptacle for a receptacle which is yet to be filled, the vacuum is interrupted and the chamber opened.

In particular, on filling highly disperse materials, one must prevent the filling material from already damming within the filling material conduit. For this, it is known from DE 10 2008 054 717 to provide a pump supply in the filling material conduit, said pump supply transporting the filling material.

The vacuum filling has been proven to be particularly advantageous, since hereby one can reliably ensure that no filling material gets into the surroundings, since the receptacle to be filled is situated within the vacuum chamber in a sealed-off manner and the air which is sucked out of the vacuum chamber can possibly yet be cleaned by filters. The more finely grained the filling material, the longer does the filling procedure last, since the gas permeability decreases with an increased filling degree of the receptacle, thus for example of the valve sack. If such a powder-like filling material of a low density is sucked into the valve sack by way of a vacuum, then this compacts into a filling material body which is less permeable to gas, and furthermore the remaining part of the gas-permeable receptacle can clog with filling material, by which means the gas permeability reduces and hence also the filling speed is slowed down.

SUMMARY

Against this background, it is the object of the invention to improve a method for filling a receptacle which is at least partly gas-permeable, in particular of a valve sack or a FIBC with bulk material, to the extent that the filling speed is increased. Furthermore, a filling device with which such an improved method can be carried out is to be provided.

A part of this object with regard to the method is achieved by a method according to the invention and a filling device for carrying out this method is disclosed herein is provided according to the invention. Advantageous embodiments of the method and of the filling device are specified in the dependent claims, the subsequent description and the drawings.

The method according to the invention for filling a receptacle which is at least partly gas-permeable, such as for example a valve sack or a FIBC, with bulk filling material, concerning which the receptacle at the outer side is subjected to an underpressure, in order to generate a feed of filling material through a filling material conduit into the inside of the receptacle, according to the invention is characterized in that after completion of a first filling time, the filling procedure is assisted by way of pressure subjection of the filling material conduit.

A basic concept of the filling method according to the invention is to provide a two-stage filling procedure, and specifically firstly in a first stage by way of vacuum filling, since this represents the most effective and quickest method for filling a receptacle given filling material of a low density and fine granulation. However, when after the initial filling the filling speed reduces due to the initially discussed problems, according to the invention the filling procedure is assisted by way of a pressure subjection of the filling material conduit and is herewith significantly accelerated compared to a purely vacuum filling or a purely pressure filling. Herein, the use of pressure subjection is preferably not effected abruptly, but in an increasing manner in accordance with the reduction of the filling speed. Herein, during the complete filling procedure, the procedure is to be controlled such that at no time does an overloading of the receptacle wall occur. This is particularly important with receptacles of paper, but in principle also with receptacles which consist of fabric or the like. The pressure subjection is effected for example by way of a feed pump which actively transports the filling material, by which means the pressure subjection is effected.

Given a suitable selection of the parameters, in practice an acceleration of the filling procedure by a factor of 2 or more compared to a purely vacuum filling can be achieved.

An underpressure in the context of the present invention is a pressure which lies below the atmospheric pressure and such an underpressure in filling technology is also denoted as a vacuum. It is therefore to be understood that a vacuum in the context of the present invention is not the ideal vacuum pressure 0, but any underpressure between this pressure 0 and the atmospheric pressure. The expression underpressure and vacuum are therefore used synonymously.

According to an advantageous further development of the method according to the invention, the pressure subjection of the filling material conduit which is assisted after the completion of the first filling time is maintained up to the end or close to the end of the filling procedure. It is to be understood that advantageously the outer-side underpressure subjection of the receptacle is retained during the complete filling procedure, wherein after the introduction of the pressure subjection of the filling material conduit, the underpressure subjection can possibly be reduced, in order not to exceed the allowable loading of the receptacle. "Up to close to the end" is to be understood as a time interval within the last 5% to 10% of the complete filling time. It can be expedient to slow down the filling procedure shortly before its end, in order to thus increase the filling accuracy. This is then expediently effected by way of the pressure impingement, thus the active filling by the pump being ended and the filling procedure only being completed by way of vacuum filling.

In practice, it has found to be advantageous if the duration of the first filling time, thus the duration during which the exclusive vacuum filling is effected, is roughly half up to two-thirds the duration of the complete filling time. If therefore the complete filling time is for example 10 seconds, then it has been found to be practical to fill exclusively by way of vacuum for the first five to seven seconds of the filling time and to only assistingly add the pressure subjection for accelerating the filling procedure after five, at the latest after seven seconds.

These values can also deviate in the individual case, and this is dependent on the density of the filling material, the grain size of the filling material, the material of the receptacle, in particular of the gas-permeable part of the receptacle and the volume of the receptacle.

Since, on vacuum filling the receptacle, the filling speed reduces with an increasing filling time, it is expedient to determine the end of the first filling time, thus the point in time when an assisting pressure subjection of the filling material conduit is to begin, by way of dropping the filling speed to a predefined value. Such a determining as a rule is more favorable than a fixed time duration of the first filling time, since by way of this individual deviations in the individual filling procedure can be better taken into account.

Advantageously, the filling method according to the invention is carried out whilst using a differential pressure closed-loop control which detects the differential pressure between the pressure which prevails in the receptacle and the pressure which surrounds the receptacle. Such a maximal differential pressure as a rule is set by the material of the receptacle and thus cannot be exceeded, in order to avoid damage to the receptacle. Such a differential pressure is advantageously closed-loop controlled to a constant value after the initial build-up at the beginning of the filling procedure, e.g. by way of PID closed-loop control. Such a differential pressure closed-loop control also ensures that the underpressure subjection is possibly reduced with the pressure subjection of the filling material conduit for assisting the filling procedure, in order to keep the material loading of the receptacle within allowable limits.

In practice, it has found to be advantageous to close-loop control the differential pressure to a value of between 300 mbar and 800 mbar, preferably between 500 mbar and 700 mbar. In particular, these values are suitable for filling valve sacks and FIBCs.

Herein, the differential pressure closed-loop control is expediently to be configured such that the underpressure subjection is maintained during the complete filling procedure, thus up to the end of the filling procedure. By way of this, one can for example ensure that no filling material gets into the surroundings, but is led away in a targeted manner.

A filling device according to the invention which is envisaged and suitable for carrying out the method according to the invention comprises an underpressure chamber, into which a filling material conduit runs, said filling material conduit being fed from a filling material container. The underpressure chamber is arranged and configured for receiving the receptacle which is to be filled. Herein, inasmuch as this is necessary, sealing means for sealing the filling material conduit with respect to the receptacle which is to be filled and into which the filling material conduit runs are provided. According to the invention, the filling device in particular is characterized in that means for the pressure subjection of the filling material conduit are provided, said means effecting a pressure subjection during the filling procedure and herewith assisting in the filling procedure.

Herein, what is essential is that the means for pressure subjection of the filling material conduit is configured such that they can be applied in an assisting manner during the filling procedure. Such means can be formed by way of suitable pumps, compressors in combination with jet-pump-like jet guides or preferably by a membrane pump which entrains as little as possible gas, in particular air, into the filling system.

On the machine side, it is advantageous to design the filling device such that two conveying conduits are provided, said conveying conduits running out into a common filling material conduit, of which one conveying conduit is for conveying underpressure and the other for conveying pressure. A suitable pressure-increasing pump, advantageously a membrane pump is provided in the conveying conduit for pressure conveying, whereas a valve with which the conduit for conveying the underpressure can be completely or partly shut off is provided in this conduit. Towards the end of the filling procedure, when the assisting pressure subjection in the conveying conduit is maximal, but the underpressure subjection in the underpressure chamber must still be present, then as a rule it is necessary to shut off the underpressure conveying conduit, in order to be able to maintain an adequate underpressure in the underpressure chamber.

Advantageously, the filling device comprises a control- and closed-loop control device which is configured for the closed-loop control of a pressure difference between the inside of the receptacle to be filled and the surrounding space in the underpressure chamber during the filling procedure. Such a control- and closed-loop control device is advantageously connected to a suitable sensor means, specifically means for detecting the pressure in the underpressure chamber and for detecting the pressure in the inside of the receptacle to be filled and/or for detecting the pressure in the filling material conduit. The pressure detection can be effected by way of pressure sensors, wherein one pressure sensor is advantageously arranged in the underpressure chamber and another at or close to the end of the filling material conduit for detecting the inner pressure. The pressure at the end of the filling material conduit, thus in the region of the filling spout is in a defined relation to the pressure in the inside of the receptacle or corresponds to this, so that by way of arranging a pressure sensor in the region of the filling spout, a complicated pressure sensor arrangement within the receptacle can mostly be done away with.

For generating the underpressure in the underpressure chamber, the filling device advantageously comprises a conduit which is connected to the underpressure chamber and which is connected to a vacuum pump, wherein a vacuum closed-loop control valve is integrated in the conduit, said vacuum closed-loop control valve being incorporated into the closed-loop control device, thus being controlled by the control- and closed-loop control device.

Basically, a corresponding control of the vacuum pump is also conceivable, but in practice the control of a vacuum closed-loop control valve is mostly simpler and quicker.

It is further advantageous to provide a shut-off valve in the filling material conduit, so that the filling procedure can be interrupted or ended firstly by way of shutting off the filling material conduit on reaching a predefined filling weight or filling volume, wherein by way of maintaining the underpressure, it is ensured that the filling material is completely brought into the receptacle to be filled and herewith the filling procedure cleanly completed before the underpressure chamber is opened for removing the filled receptacle.

The invention is hereinafter explained in more detail by way of an embodiment example which is represented in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
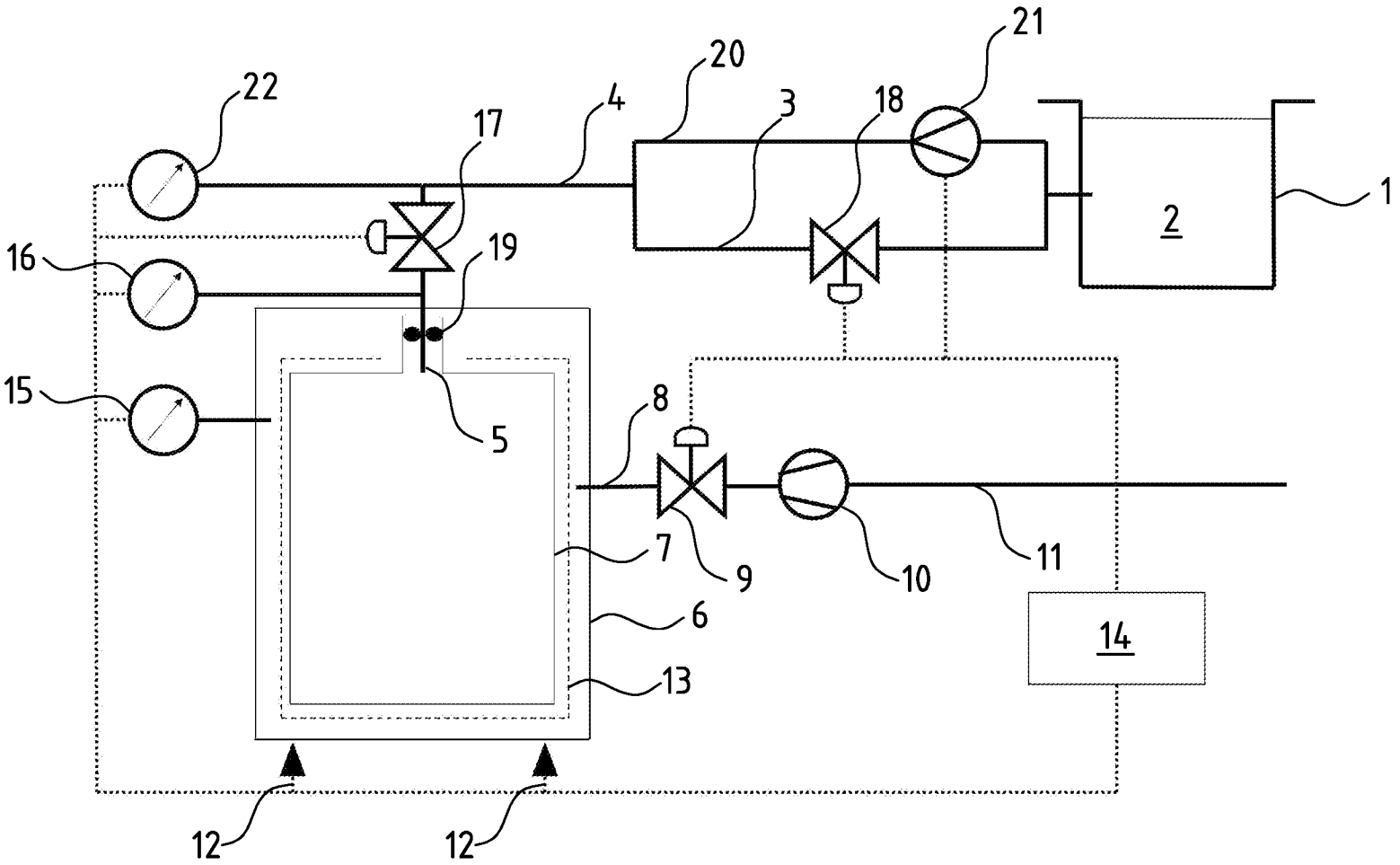
FIG. 1 is greatly schematic and simplified illustration of the basic construction of a filling device according to the invention.

Referring to the drawings, the filling device which is represented by way of FIG. 1 includes some mechanical construction features that are essentially configured as are also known from vacuum packers according to the state of the art, and in this context a vacuum packer of GREIF-VELOX Maschinenfabrik GmbH in Lübeck of the type VeloVac is referred to.

The filling device comprises a supply container 1 for receiving filling material 2, said supply container being connected to a filling material conduit 4 via a conveying conduit 3. A filling spout 5 which ends within a vacuum chamber 6 which is configured for receiving a receptacle 7 to be filled is arranged at the end of the filling material conduit 4. This vacuum chamber 6 which can be closed off with respect to the surroundings in a complete manner is connected to a vacuum pump 10 via a vacuum conduit 8 amid the intermediate arrangement of a vacuum closed-loop control valve 9, and the outlet conduit 11 of this vacuum pump runs out into the outer atmosphere possibly amid the intermediate arrangement of filters.

Herein, the vacuum chamber 6 is connected to the machine mount via a weighing device 12, with which the filling weight of the receptacle 7 can be determined. A support body 13 which serves for the lateral and base-side support of the receptacle 7 during the filling procedure is arranged within the vacuum chamber 6. This support body 13 is configured in a grid-like manner.

Furthermore, the filling device comprises a control- and closed-loop control device 14 which at the outlet side is envisaged for the control of the vacuum closed-loop control valve 9 and at the inlet side via a first pressure sensor 15 detects the pressure in the vacuum chamber 6 and via a second pressure sensor 16 the pressure within the receptacle 7. This second pressure sensor 16 at the end of the filling material conduit 4 is arranged within the filling spout 5.

A shut-off valve 17 is arranged in the filling material conduit 4, said shut-off valve being controlled by the control- and closed-loop control device 14 and not only being provided for the opening and closing of the filling material conduit 14, but can also be brought into intermediate positions. A corresponding shut-off valve 18 is provided in the conveying conduit 3 from the supply container 1 to the filling material conduit 4.

The vacuum chamber 6 can be opened for the purpose of removing a filled receptacle 7 and for bringing in an empty receptacle 7 and the filling spout 5 is sealingly led into the vacuum chamber 6 and is sealed off with respect to the receptacle 7 via a seal 19. The construction which is described above corresponds to that of a vacuum packer according to the state of the art.

In contrast to this, the filling device additionally comprises a second conveying conduit 20 which is led parallel to the conveying conduit 3, likewise connects the supply container 1 to the filling material conduit 4 and in which a membrane pump 21 is integrated, said membrane pump being controlled by the control- and closed-loop control device 14. Furthermore, the filling device comprises a third pressure sensor 22 which detects the pressure in the filling material conduit 4 between the conveying conduit 3, 20 and the shut-off valve 17. This sensor 22 is also signal-connected to the control- and closed-loop control device 14.

The filling of a receptacle 7 by the filling device which is described above is herein effected as follows:

The receptacle 7, for example a valve sack, given an opened vacuum chamber 6 is placed with a filling valve onto the filling spout 5, whereupon the seal 19 which annularly surrounds the filling spout 5 is subjected to pressurized air, by which means this is sealed off with respect to the inside of the valve sack 7. The valve sack is located within the support body 13 within the vacuum chamber 6 which is sealingly closed after placing on the valve sack 7. Given a closed vacuum closed-loop control valve 9, the vacuum pump 10 is then switched on and the filling procedure begins by way of the shut-off valves 17 and 18 being opened and the closed-loop control valve 9 being opened at the point in time t0.

Figure 2:
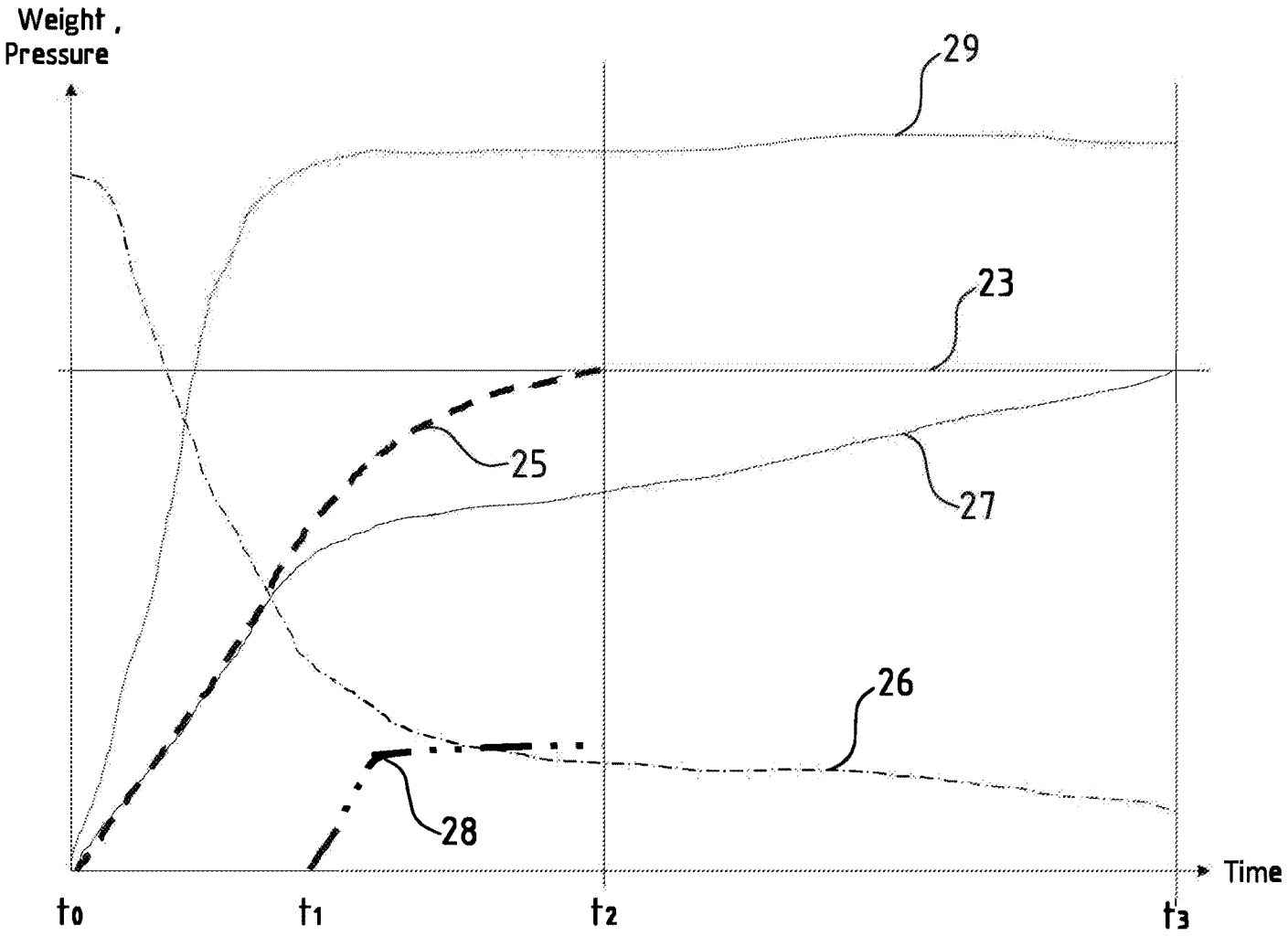
FIG. 2 is a diagram relating to the filling procedure over time, according to the method according to the invention and according to the state of the art.

On opening the closed-loop control valve 9, the vacuum chamber 6 is subjected to an underpressure, by which means a delivery flow of filling material 2 is effected through the conveying conduit 3, the filling material conduit 4 and the filling spout 5, into the inside of the valve sack 7. Herein, the weight of the sack 7 is detected by the weighing device 7. The course of the product weight from the beginning of the filling procedure t0 up to reaching the nominal weight at the point in time t2 is represented in FIG. 2 by the dashed curve 25. Herein, the filling of the valve sack 7 up to a point in time t1 is effected exclusively by way of underpressure, thus as is also effected with common vacuum filling technology. During this first filling time which lasts from t0 to t1, the filling of the receptacle 7 is effected exclusively by underpressure in the vacuum chamber 6. The dot-dashed curve 26 in FIG. 2 represents the product flow which is generated by the underpressure. The initially outlined effect of the product flow which is generated by the underpressure dropping more and more after an initially very high product flow is clearly visible by way of the curve 26.

When the product flow drops to a predefined value or however the speed of the increase of the product weight, as is represented in curve 25, drops to a certain value, then the point in time t1 is reached, which means the first filling time in which one fills exclusively by way of an underpressure is completed. At the point in time t1, the membrane pump 21 is activated in a delivering manner and the shut-off valve 18 in the conveying conduit 3 is activated into closing, so that now apart from the product weight which is generated by underpressure and which is represented in the curve 27 in FIG. 2 by an unbroken line, a further product flow which is caused by the pressure in the conveying conduit 20, said pressure being produced by the membrane pump 21, and subsequently in the filling material conduit 4 additionally kicks in. The filling weight which is additionally generated by the feed pump 21 is represented in the curve 28 in FIG. 2 which is double-dot-dashed. Hence now after the first filling time at the point in time t1 up to the end of the filling time at the point in time t2, a part of the product weight is generated by the underpressure which is generated by the pump 10 and a part of the product weight by the overpressure which is generated by the pump 21. The product weight which is produced by the respective conveying flows sum, so that the curve 25 has reached the nominal weight 23 already at the point in time t2, thus after the end of the filling time. In the example which is represented by way of FIG. 2, it is evident that the duration of the first filling time t0 to t1 contributes to roughly half the complete filling duration t0 to t2.

For a comparison, in FIG. 2 it is represented how long it would last to reach the nominal weight 23 exclusively by way of vacuum filling. This would not be reached until at a time t3, wherein the filling time which is necessary with the combined underpressure-overpressure filling (duration from t0 to t2) is only roughly half as long as the filling time which is necessary given a purely vacuum filling (duration t0 to t3).

Figure 3:
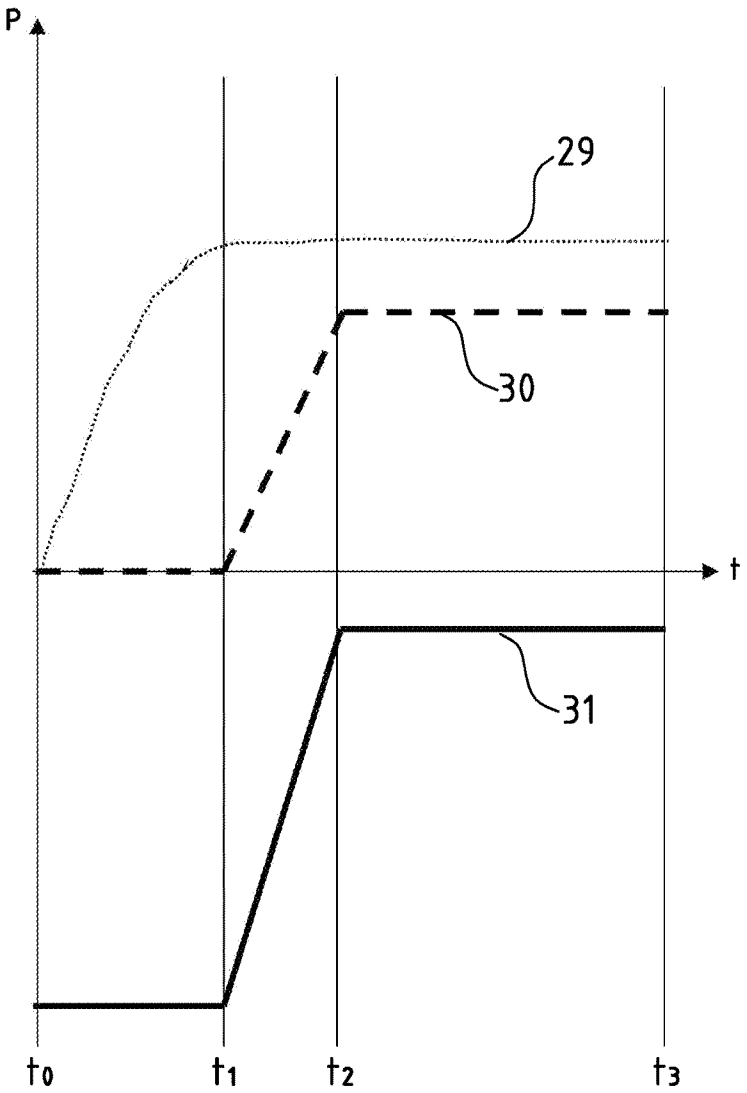
FIG. 3 is a diagram relating to the pressure course during the filling procedure.

As the dotted curve 29 which is illustrated in FIG. 2 makes clear, the closed-loop control is effected via the differential pressure between the inside of the sack and the surroundings within the vacuum chamber 6, thus on the basis of the differential pressure which is determined by the sensors 15 and 16. After an initial build up, this is to be closed-loop controlled in a constant as possible manner. In practice, this means given a pressure subjection of the conveying conduit 20 and in the filling material conduit 4, the vacuum closed-loop control valve 9 must be moved back, in order to keep the differential pressure constant. Since the underpressure subjection of the vacuum chamber 6 is to be maintained up to the end of the filling time, thus up to the point in time t2, the underpressure valve 9 is to be activated such that the underpressure is reduced in comparison to that underpressure which is necessary during the first filling time. This is represented schematically by way of FIG. 3 which shows the pressure course over time. There, the differential pressure is represented as a curve 29 corresponding to the curve 29 in FIG. 2. The dashed curve 30 herein shows the pressure which is mustered by the delivery pump 21, whereas the unbroken curve 31 represents the pressure (underpressure) which is produced by the vacuum pump 10 in combination with the vacuum closed-loop control valve 9. The differential pressure 29 results from the addition of the overpressure which is produced by the pump and of the underpressure according to curve 31, produced by the pump 10.

Basically, this multi-stage filling method can also be effected in pressure levels, but what is decisive is the fact that the allowable pressure difference is not exceeded, which at the same time limits the speed of the filling procedure.

While specific embodiments of the invention have been shown and described in detail to illustrate the application of the principles of the invention, it will be understood that the invention may be embodied otherwise without departing from such principles.

LIST OF REFERENCE NUMERALS

1 supply container
2 filling material
3 conveying conduit
4 filling material conduit
5 filling spout
6 vacuum chamber
7 receptacle
8 vacuum conduit
9 vacuum closed-loop control valve
10 vacuum pump
11 outlet conduit
12 weighing device
13 support body
14 control- and closed-loop control device
15 first pressure sensor
16 second pressure sensor
17 shut-off valve
18 shut-off valve
29 seal
20 further conveying conduit
21 membrane pump
22 third pressure sensor
23 nominal weight
25 dashed curve, temporal course of the product weight in the receptacle 7
26 dot-dashed curve, temporal course of the product flow which is generated by underpressure
27 curve which shows the temporal course of the product weight in the receptacle 7, said weight being produced by the underpressure
28 double-dotted-dashed curve which shows the temporal course of the product weight which is produced by the feed pump
29 dotted curve which shows the pressure difference between the receptacle inside and the inside of the vacuum chamber
30 a dashed curve which shows the pressure which is generated by the pump 21
31 curve which shows the underpressure which is generated by the vacuum pump 10

What is claimed is:

1. A method for filling a receptacle, which is at least partly gas-permeable, with bulk filling material, the method comprising the steps of:

subjecting an outer side of the receptacle to an underpressure, in order to generate a feed of filling material through a filling material conduit into an inside of the receptacle as part of a filling procedure; and subjecting the filling material conduit to pressure after completion of a first filling time of the filling procedure to assist the filling procedure including the feed of filling material through the filling material conduit, wherein an end of the first filling time is determined by a dropping of a filling speed to a predefined value.

2. A method according to claim 1, wherein the assistance of the filling procedure by way of subjecting the filling material conduit to pressure is maintained up to an end or close to an end of the filling procedure.

3. A method according to claim 1, wherein a duration of the first filling time is from half up to two-thirds of a duration of a complete filling time of the filling procedure.

4. A method according to claim 1, wherein a differential pressure closed-loop control between the pressure which prevails in the receptacle and the pressure which surrounds the receptacle is effected.

5. A method according to claim 4, wherein the differential pressure is closed-loop controlled to a value of between 300 mbar and 800 mbar.

6. A method according to claim 5, wherein the differential pressure is closed-loop controlled to a value of between 500 mbar and 700 mbar.

7. A method according to claim 1, wherein the subjecting the outer side of the receptacle to an underpressure is retained up to the end of the filling procedure.

8. A filling device for filling a receptacle, which is at least partly gas-permeable, with bulk filling material, the filling device comprising:

a filling material conduit fed from a filling material container;

an underpressure chamber, wherein the filling material conduit runs out into the underpressure chamber, wherein the underpressure chamber is arranged and configured for receiving the receptacle which is to be filled and the underpressure chamber is configured to subject an outer side of the receptacle, to be filled, to an underpressure, in order to generate a feed of filling material through a filling material conduit into an inside of the receptacle as part of a filling procedure;

sealing means for sealing the filling material conduit with respect to the receptacle which is to be filled and into which the filling material conduit runs; and pressure means for subjecting the filling material conduit to pressure, during the filling procedure after completion of a first filling time of the filling procedure, to assist the filling procedure including the feed of filling material through the filling material conduit, wherein an end of the first filling time is determined by a dropping of a filling speed to a predefined value.

9. A filling device according to claim 8, wherein the pressure means comprises a membrane pump.

10. A filling device according to claim 8, further comprising:

a first conveying conduit; and a second conveying conduit, to provide two conveying conduits running out into the filling material conduit, wherein:

one of the two conveying conduits is for conveying an underpressure; and another of the two conveying conduits is for conveying pressure.

11. A filling device according to claim 8, further comprising a control- and closed-loop control device configured to closed-loop control a pressure difference between the inside of the receptacle to be filled and the surrounding space in the vacuum chamber, during the filling procedure.

12. A filling device according to claim 11, further comprising:

a vacuum closed-loop control valve;

a vacuum pump; and a conduit, wherein the underpressure chamber is connected to the vacuum pump via the conduit, and the vacuum closed-loop control valve, which is controlled by the closed-loop control device, is integrated in the conduit.

13. A filling device according to claim 8, further comprising a shut-off valve integrated in the conveying conduit for conveying underpressure.

14. A filling device according to claim 8, further comprising a shut-off valve provided in the filling material conduit.

15. A filling device according to claim 8, further comprising means for detecting at least one of:

a pressure level in the underpressure chamber;

a pressure level in the inside of the receptacle to be filled; and a pressure level in the filling material conduit.

16. A filling device for filling a receptacle, which is at least partly gas-permeable, with bulk filling material, the filling device comprising:

a filling material conduit fed from a filling material container;

an underpressure chamber, wherein the filling material conduit runs out into the underpressure chamber, wherein the underpressure chamber is arranged and configured for receiving the receptacle which is to be filled and the underpressure chamber is configured to subject an outer side of the receptacle, to be filled, to an underpressure, in order to generate a feed of filling material through a filling material conduit into an inside of the receptacle as part of a filling procedure;

a sealing means for sealing the filling material conduit with respect to the receptacle which is to be filled and into which the filling material conduit runs;

a pressure means for subjecting the filling material conduit to pressure, during the filling procedure after completion of a first filling time of the filling procedure, to assist the filling procedure including the feed of filling material through the filling material conduit; and a control device configured to at least determine an end of the first filling time based on a filling speed reaching a predefined value.

17. A filling device according to claim 16, wherein the pressure means comprises a membrane pump.

18. A filling device according to claim 16, further comprising:

a first conveying conduit; and a second conveying conduit, to provide two conveying conduits running out into the filling material conduit, wherein:

one of the two conveying conduits is for conveying an underpressure; and another of the two conveying conduits is for conveying pressure.

19. A filling device according to claim 16, wherein the control device is further configured to closed-loop control a pressure difference between the inside of the receptacle to be filled and the surrounding space in the vacuum chamber, during the filling procedure.

20. A filling device according to claim 19, further comprising:

a vacuum closed-loop control valve;

a vacuum pump; and a conduit, wherein the underpressure chamber is connected to the vacuum pump via the conduit, and the vacuum closed-loop control valve, which is controlled by the closed-loop control device, is integrated in the conduit.

* * * * *